US008087102B2

(12) United States Patent
Kordecki

(10) Patent No.: US 8,087,102 B2
(45) Date of Patent: Jan. 3, 2012

(54) PROTECTIVE SHOULDER PADS WITH RELEASE MECHANISMS

(76) Inventor: Michael E Kordecki, Vernon Hills, IL (US)

( * ) Notice: Subject to any disclaimer, the term of this patent is extended or adjusted under 35 U.S.C. 154(b) by 410 days.

(21) Appl. No.: 12/290,510

(22) Filed: Oct. 31, 2008

(65) Prior Publication Data

US 2010/0107321 A1 May 6, 2010

(51) Int. Cl.
*A41D 27/26* (2006.01)

(52) U.S. Cl. ..... 2/462; 2/459; 2/460; 2/461; 2/463; 2/455

(58) Field of Classification Search ..... 2/461, 462, 2/463, 464, 465, 459, 460, 102, 94, 44, 45
See application file for complete search history.

(56) References Cited

U.S. PATENT DOCUMENTS

| | | | | |
|---|---|---|---|---|
| 1,298,618 | A | 3/1919 | Wloszek | |
| 2,477,989 | A | 8/1949 | LaMaida | |
| 3,431,560 | A | 3/1969 | Austin | |
| 3,514,784 | A | 6/1970 | McDavid | |
| 3,740,762 | A | 6/1973 | Truelove | |
| 3,740,763 | A * | 6/1973 | Mitchell | 2/462 |
| 4,694,505 | A | 9/1987 | Flosi et al. | |
| 5,029,341 | A | 7/1991 | Wingo | |
| 5,107,542 | A * | 4/1992 | Zide et al. | 2/462 |
| 5,204,993 | A | 4/1993 | Siemens | |
| 5,337,417 | A | 8/1994 | Whiteside et al. | |
| 6,769,137 | B2 | 8/2004 | D'Annunzio | |
| 6,948,188 | B2 | 9/2005 | D'Annunzio | |
| 7,020,897 | B2 | 4/2006 | Johnson | |
| 7,047,570 | B2 | 5/2006 | Johnson | |
| 7,243,376 | B2 | 7/2007 | Johnson | |
| 7,424,748 | B1 | 9/2008 | McDunn et al. | |
| 2006/0010590 | A1 | 1/2006 | Huschke et al. | |
| 2008/0263737 | A1 | 10/2008 | Parks et al. | |

FOREIGN PATENT DOCUMENTS

| | | | |
|---|---|---|---|
| WO | 2008108856 | A2 | 9/2008 |
| WO | 2009051619 | A2 | 4/2009 |

* cited by examiner

*Primary Examiner* — Gary L Welch
*Assistant Examiner* — Andrew W Collins
(74) *Attorney, Agent, or Firm* — The Law Office of Paul C. Pecoraro, P.C.; Paul C. Pecoraro

(57) ABSTRACT

This invention concerns improved protective shoulder pads for protecting an individual wearing the protective shoulder pads against impact to the superior, anterior, posterior and/or lateral regions of the shoulder and upper arm. The improvement comprises protective shoulder pads with release mechanisms that allow the protective shoulder pads to be safely and easily removed from the individual wearing the protective shoulder pads while the individual wearing the protective shoulder pads is maintained in the supine position, thus decreasing the risk of further injuring the individual wearing the protective shoulder pads.

3 Claims, 6 Drawing Sheets

PROTECTIVE SHOULDER PADS WITH RELEASE MECHANISMS

BACKGROUND OF THE INVENTION

1. Field of the Invention

This invention relates generally to protective shoulder pads such as those worn by individuals participating in athletic activities. In particular, this invention improves currently available protective shoulder pads with a feature that allows emergency medical personnel or others to safely and easily remove the protective shoulder pads from the individual wearing the shoulder pads in case of suspected neck or cervical spine injury.

2. Description of the Related Art

Protective shoulder pads are commonly used by athletes and other individuals to protect the individual's shoulders, chest, upper and lower back, and upper arms from impact that may result in injury. For example, protective shoulder pads are utilized in sports where collision is inherent and produces a significant risk of injury, such as football and hockey. However, individuals wearing protective shoulder pads are generally reluctant to use protection for the fragile neck and upper spine because this protection significantly diminishes the mobility that athletes and other individuals desire. As a result, the neck and upper spine are more susceptible to injury than other parts of the human body.

When such neck or cervical spine injuries occur, protective shoulder pads themselves become a risk factor for iatrogenic injury during the course of initial medical evaluation and management. Currently available protective shoulder pads only allow removal as an entire unit. The proper technique for protective shoulder pad removal includes one member of the medical team maintaining manual stabilization of the athlete's head and neck at all times. While that member of the medical team remains in place manually stabilizing the head and neck, the injured athlete's torso is elevated to a 30-40 degree angle by flexing the athlete's lower spine and hips. While in this compromised position, the protective shoulder pads are then maneuvered in a manner to remove them, essentially, over the head of the injured athlete. This maneuver is extremely complicated and may potentially cause a secondary injury. Research in the field of spinal cord injury has demonstrated up to 25% of cervical spinal cord injured patients experience neurologic deterioration during the course of initial evaluation and management.

In the event that an individual suffers a suspected injury to the spine or neck, the current practice in the medical profession is to stabilize the individual in the supine position while diagnosing and treating the individual. The National Athletic Trainers' Association's guidelines and recommendations in this field, *Prehospital Care of the Spine-Injured Athlete*, require that any athlete who is suspected of having a head and/or spinal injury should be managed as though a spinal injury exists, and if unconscious, the player is presumed to have an unstable fracture until it is proved otherwise. The guidelines further state that the improper management of a suspected spinal injury can result in a secondary injury. Head and shoulder stabilization must be maintained during any manipulation and removal of equipment to avoid cervical movement, lateral flexion and other movements which could lead to further injury.

While providing stabilization to the wearer's spine, the protective shoulder pads must be removed from the injured athlete while lying supine to aid in the diagnosis and treatment of a suspected cervical spine or neck injury. The current National Athletic Trainers' Association's guidelines and recommendations require at least four individuals to remove currently available shoulder pads. Realizing the importance of limiting the amount of unnecessary movement during this process to prevent a secondary injury, the guidelines recommend removing the protective shoulder pads only to an extent that full access to chest, face, neck, and arms may be accessed. The National Athletic Trainers' Association's suggested method comprises the steps of cutting all soft clothing and soft portions of the shoulder pads with a knife or equivalent cutting apparatus as required to spread the two anterior halves of the protective shoulder pads that are currently available. However, the repositioning of the protective shoulder pads to this limited extent precludes sufficient access to the neck and cervical spine areas that medical personnel must access to diagnose and treat an individual with a suspected cervical spine injury.

Recent unpublished studies by Rechtine and Horodysky at the University of Rochester have demonstrated significant motion in the cervical spine during shoulder pad removal despite the utilization of optimal techniques that are currently recommended by national athletic training and trauma specialty organizations. The consequences of such motion may include loss of one or more levels of neurological function in the acute spinal cord injured athlete. This alone could result in a potentially ambulatory athlete becoming non-ambulatory, an independent athlete becoming dependent, or an athlete who may have independent respiration becoming respirator dependent. The human cost and the cost to society of such deterioration are enormous. No current protective shoulder pad design allows for the safe removal of the protective shoulder pads from an individual immobilized in the supine position by less than four properly trained people. Furthermore, current protective shoulder pad designs prevent both stabilization of the potentially injured athlete and an acceptable quality of radiographic imaging.

In their article *Helmet and Shoulder Pad Removal in Football Players with Unstable Cervical Spine Injuries*, M. C. Dahl, D. Ananthakrishnan, G. Nicandri, and R. P. Ching, the authors, while recognizing that "patient handling is often impaired due to the protective equipment worn and improper stabilization of these patients can exacerbate neurologic injury," the authors discussed alternative methods for removing protective shoulder pads and the resulting detriments caused by each method. The levitation technique was found to produce motion in the anterior and right lateral directions. The tilt technique resulted in motions in the posterior left lateral directions, and the log roll technique generated motions in the right lateral direction and had the largest amount of increased instability when comparing the intact and lesioned specimen. According to the authors, "these findings suggest that each method of equipment removal displays unique weaknesses that the practitioner should take into account."

In another study, the amount of motion that occurred during protective shoulder pad removal in a cadaver with an injured spine was evaluated and quantified. *Helmet and shoulder pad removal from a player with suspected cervical spine injury. A cadaveric model Spine*. W F Donaldson, W C Lauerman, B Heil, R Blanc, T Swenson. 1998. The authors of the study concluded that shoulder pad removal in the unstable cervical spine is a complex maneuver, and that because of the motion observed in the unstable spine, shoulder pad removal should be performed in a carefully monitored setting by at least three, preferably four, trained people.

Another problem with currently available shoulder pads is that different types of protective shoulder pads are available for specific purposes, and the different types exacerbate the problems in removing the shoulder pads. Specific models of protective shoulder pads have posterior portions of the shoulder pads that protect down to the small of the user's back. The injured athlete must be moved to a greater degree to remove the shoulder pads, thus increasing the potential for a secondary injury. The weight of the wearer's torso exerted on the posterior member of the shoulder pads prevents easy removal of the shoulder pads, and as discussed, it is undesirable to move the individual wearing the protective shoulder pads. Another complication of attempting to remove protective shoulder pads over the head of an individual is the weight and mass of the individual. Large and heavy individuals are more difficult to lift and their body mass proves detrimental to the removal of the protective shoulder pads, thus requiring more movement of the individual and increasing the potential for a secondary injury in a person with a suspected neck or cervical spine injury.

Thus, existing protective shoulder pads become an impediment to diagnosing and treating an individual while in the supine position and the removal of the shoulder pads may potentially cause a secondary injury. The removal of the protective shoulder pads requires significant movement of the wearer by at least four trained medical personnel. While the prior art of protective shoulder pads satisfactorily reduces the risk of injury to the individual's shoulders, chest, upper and lower back, and upper arms, no protective shoulder pad is available that allows for removal of the shoulder pads and allows for sufficient access to the wearer's neck and spine while maintaining the neck and spine in a neutral position while in the supine position.

These improved protective shoulder pads provide a solution to the challenges of diagnosing and treating suspected neck and spinal injuries. By allowing the removal of the shoulder pads while maintaining the neck and spine in the neutral position, these improved shoulder pads substantially eliminate the risk of further injury to an individual wearing shoulder pads with a suspected neck or spinal injury. The benefit of these improved protective shoulder pads is the ease and effectiveness of removal of those portions of the protective shoulder pads that typically present obstacles to the effective diagnosis and treatment. Once these portions are removed, medical personnel can more effectively diagnose and treat the individual suspected of a cervical spine or neck injury. The release mechanisms for the protective shoulder pads address the risk of increasing neurologic injury in the spinal cord injured athlete by eliminating the spinal motion demonstrated by Rechtine during shoulder pad removal. The invention provides for removal of the shoulder pads by simple release mechanisms which are easily accessible by first responders and medical professionals. Once the protective shoulder pads are safely removed, the injured athlete's spine becomes readily accessible for stabilization and radiographic evaluation.

BRIEF SUMMARY OF THE INVENTION

Utilizing mechanical fasteners or equivalent which allow for removal of the posterior portions of the protective shoulder pads from the superior portions of the protective shoulder pads while the individual wearing the protective shoulder pads is in the supine position, the posterior portions of the protective shoulder pads are attached to the superior portions of the protective shoulder pads at approximately the 3rd and 4th thoracic vertebrae. The mechanical fasteners or equivalent allow for efficient and simple detachment of the posterior portions of the protective shoulder pads from the superior, anterior, and lateral portions of the protective shoulder pads while the individual suspected of the cervical spine or neck injury is lying in the supine position. The posterior portions of the protective shoulder pads can be subsequently reattached to the remaining portions of the protective shoulder pads if desired. Alternatively, using a mechanical fastener or equivalent which allows for detachment of the left shoulder portion of the protective shoulder pads from the right shoulder portion of the protective shoulder pads while the individual wearing the shoulder pads is in the supine position, the left shoulder pad and the right shoulder pad may be separated from each other and removed from underneath the individual while the individual is lying in the supine position. The left shoulder pad and the right shoulder pad can be subsequently reattached in this alternate configuration if desired.

The weight of the individual's torso on the posterior portion of the shoulder pads becomes immaterial because there is no requirement for the individual to be repositioned to effectuate removal of the portion of the protective shoulder pads that impedes treatment and diagnosis of the suspected cervical spine or neck injury. Upon removal, medical personnel and others gain access to the location of the suspected cervical spine and neck injury to treat the injury. Additionally, radiographic imaging machines can be positioned to provide clearer images of the suspected injury while only the posterior portions of the protective shoulder pads, or in the alternative, no portions of the protective shoulder pads remain in place.

BRIEF DESCRIPTION OF THE SEVERAL VIEWS OF THE DRAWINGS

For a better understanding of the invention, reference may be had to the following detailed description taken in conjunction with the accompanying drawings in which.

DETAILED DESCRIPTION OF THE INVENTION

Figure 1:
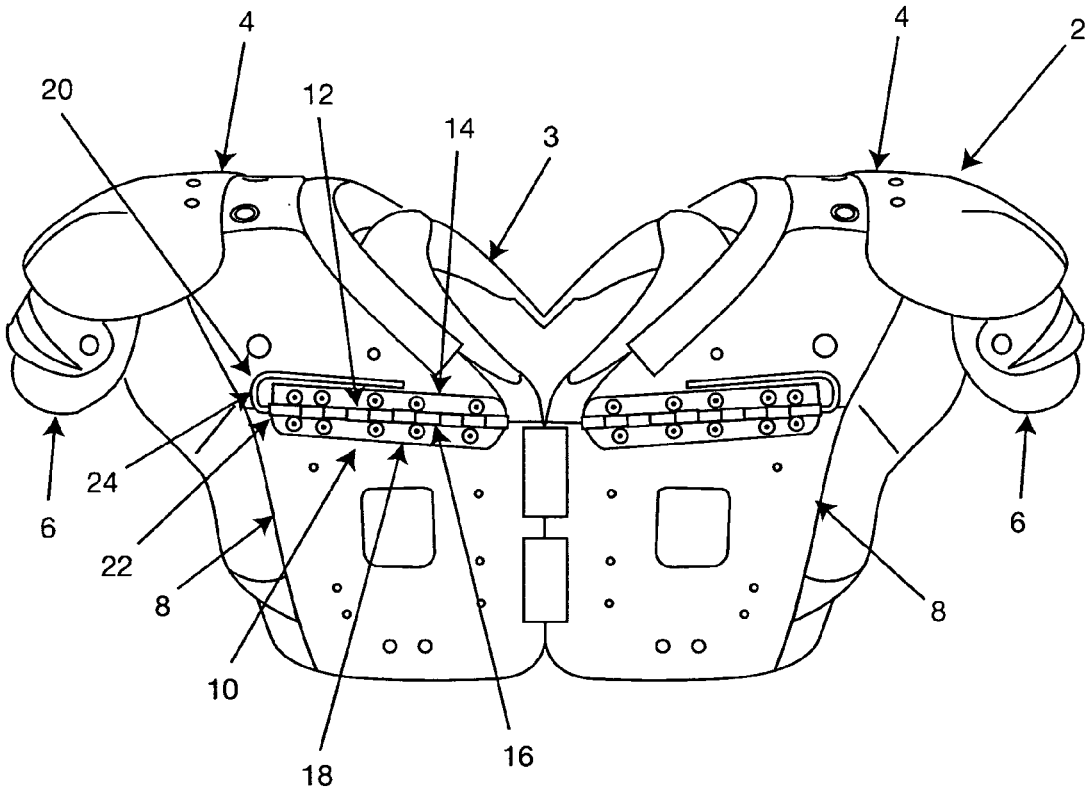
FIG. 1 illustrates a distal plan view of one embodiment of the present invention, in which hinges with the hingepins intact are shown as the mechanical connections.
Figure 2:
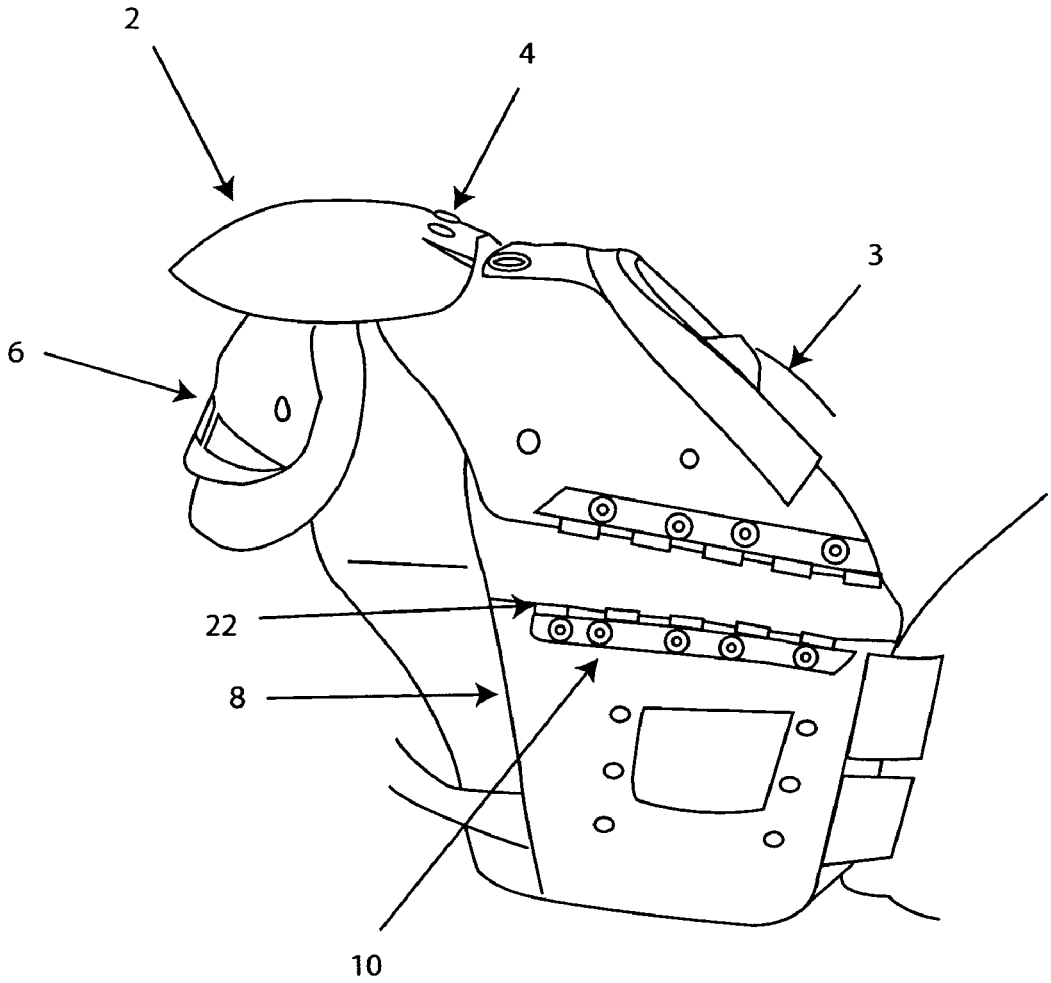
FIG. 2 illustrates a partial distal plan view of the same embodiment of the present invention as shown in FIG. 1, in which one hingepin is removed from the hinge.

The protective shoulder pads 2 shown in FIGS. 1 and 2 in accordance with the present invention protect the chest, shoulders, upper back, and upper arms of the individual wearing the shoulder pads 2. The anterior portions 3 of the shoulder pads 2 protect the individual's chest, the superior portions 4 of the protective shoulder pads 2 protect the individual's shoulders, the lateral portions 6 of the protective shoulder pads 2 protect the individual's upper arms, and the posterior portions 8 of the protective shoulder pads 2 protect the individual's upper back.

As can be seen in FIG. 1, the posterior portions 8 of the protective shoulder pads 2 are mechanically coupled to the superior portions 4 of the protective shoulder pads 2 with a hinge 10. The hinge knuckles 12 of the hinge leaf 14 that is attached to the superior portion 4 of each protective shoulder pad 2 mate at the hinge knuckles 16 of the hinge leaf 18 that is attached to the posterior portion 8 of the protective shoulder pads 2. Alternatively, the superior hinge knuckles 12 and the posterior hinge knuckles 16 can be manufactured into each of the superior portions 4 and posterior portions 8 of the protective shoulder pads 2. A hingepin 20 is inserted into the hinge opening 22 formed by the apertures in each of the superior hinge knuckles 12 and the posterior hinge knuckles 16, mechanically connecting the superior portion 4 of the protective shoulder pads 2 to the posterior portion 8 of the protective shoulder pads 2. The outer end of the hingepin 20 has a curved end 24 to allow for a person other than the individual wearing the protective shoulder pads to remove the hingepin 20 laterally out of the hinge opening 22 while the individual wearing the protective shoulder pads is lying in the supine position.

FIG. 2 illustrates the state of the protective shoulder pads after one of the hingepins is removed from the hinge opening 22 of the hinge 10. Subsequent to removing both hingepins from each hinge opening 22 on each side of the protective shoulder pads 2, the anterior, superior, and lateral portions of the protective shoulder pads 2 can be removed from the individual wearing the protective shoulder pads 2 by separating the anterior portion 3, the superior portion 4, and lateral portion 6 of the protective shoulder pads 2 from the posterior portions 8 of the protective shoulder pads 2. A full diagnosis of the individual who was wearing the protective shoulder pads 2 can then be performed without moving the individual wearing the protective shoulder pads 2 to any detrimental degree. The posterior portions 8 of the protective shoulder pads may be recoupled to the superior portions 4 of the protective shoulder pads 2 for future use.

FIG. 3, FIG. 4, FIG. 5, and FIG. 6 illustrate another embodiment of the present invention.

Figure 3:
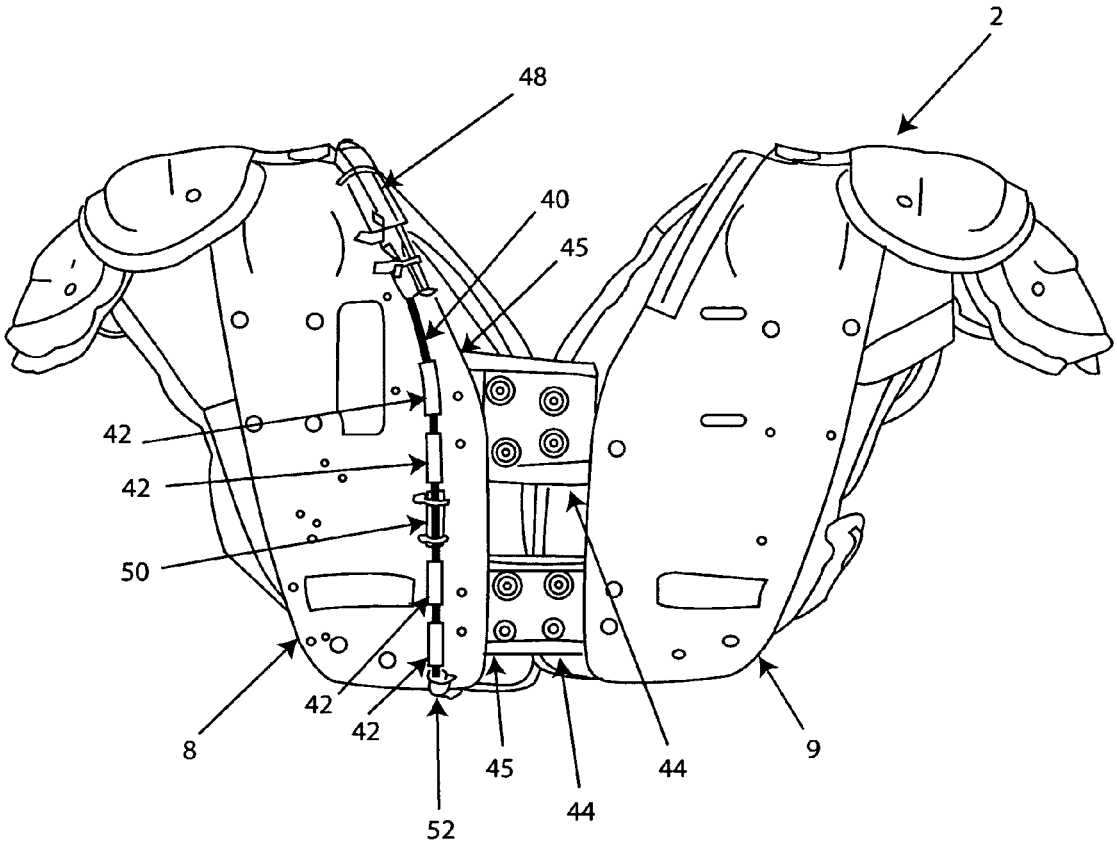
FIG. 3 illustrates a distal plan view of a second embodiment of the present invention, in which a removable cable retains the straps that couple both the left and right halves of the protective shoulder pads.
Figure 4:
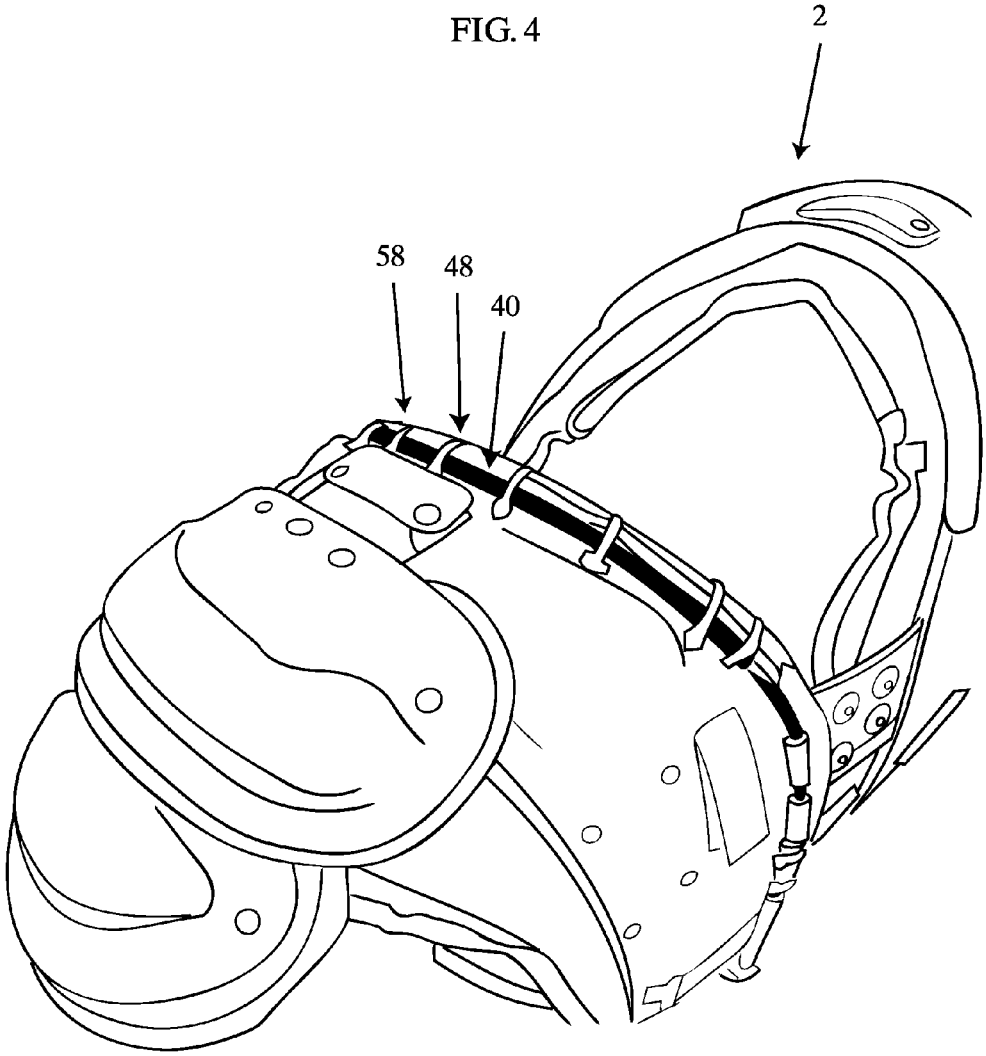
FIG. 4 illustrates a partial lateral prospective view of the embodiment of the present invention illustrated in FIG. 3, in which the removable retaining cable is channeled towards the anterior portion of the protective shoulder pads.
Figure 5:
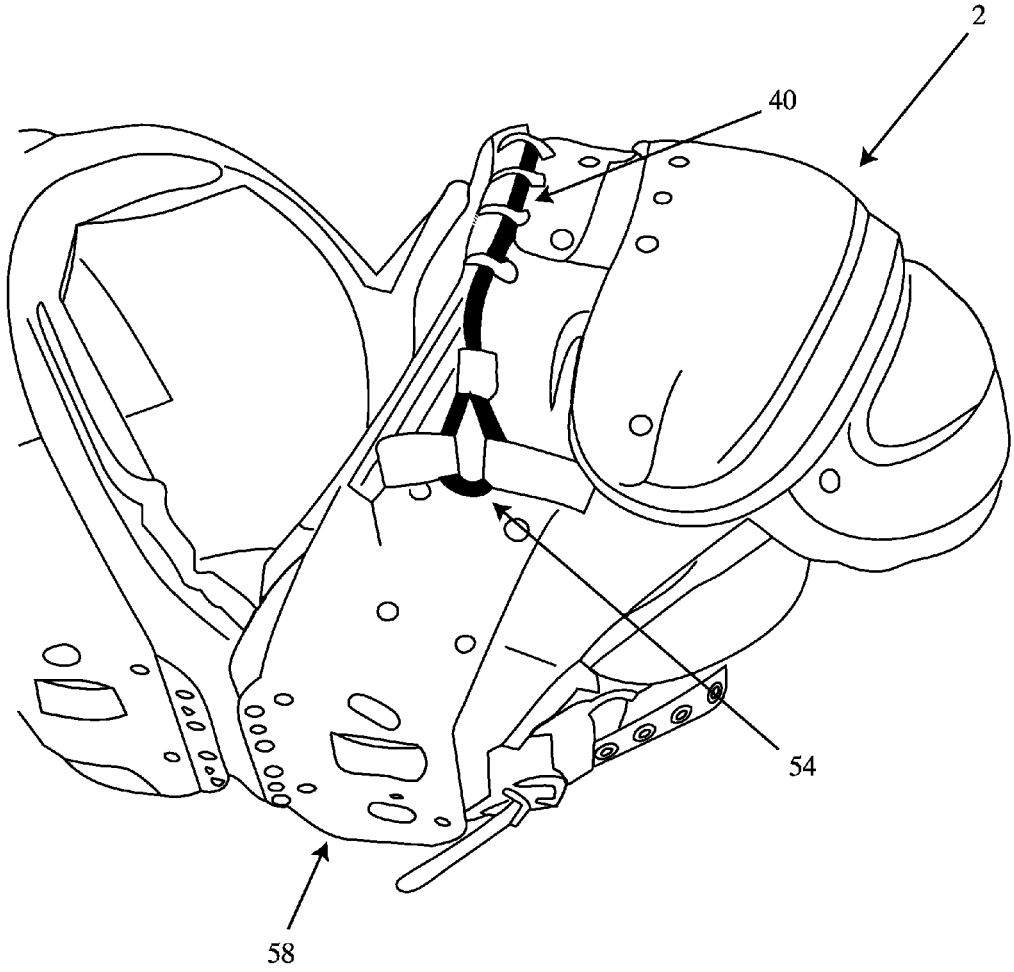
FIG. 5 illustrates a partial frontal prospective view of the embodiment of the present invention illustrated in FIG. 3, in which a loop on the anterior end of the retaining cable is used to remove the retaining cable from the straps that couple both the left and right halves of the protective shoulder pads.
Figure 6:
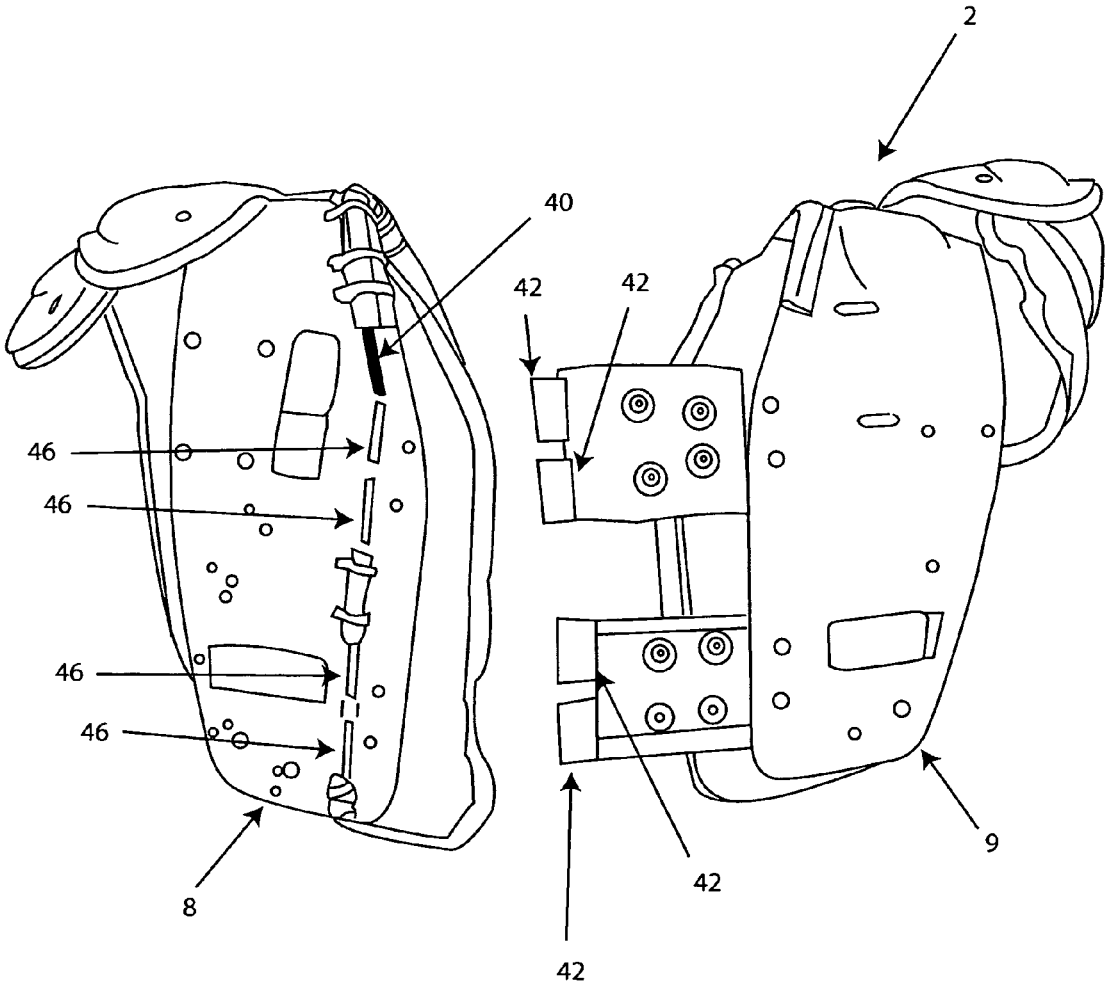
FIG. 6 illustrates a distal plan view of the embodiment of the present invention illustrated in FIG. 3, in which the left and right halves of the protective shoulder pads are decoupled.

As can be seen in FIG. 3, a retaining cable 40 is passed through retaining loops 42 that are fabricated onto one end 45 of each of the straps 44 that couple the left posterior portion 8 of the protective shoulder pads 2 to the right posterior portion 9 of the protective shoulder pads 2. The retention cable 40 prevents the retaining loops 42 from passing through apertures in the body of the protective shoulder pads 2. The retaining cable 40 is guided along its desired path via guidance channel 48 and guidance channel 50 to maintain ease of removal during actuation. One end of the retaining cable 40 terminates in a terminating channel 52. As FIG. 4 illustrates, the retaining cable 40 is routed through guidance channels 48 toward the anterior portion 58 of the protective shoulder pads 2. As FIG. 5 illustrates, the anterior end 54 of the retaining cable 40 terminates at the anterior portion 58 of the protective shoulder pads 2. Returning to FIG. 3, during actuation, with the individual wearing the protective shoulder pads 2 maintained in the supine position, the retaining cable 40 is removed through retaining loops 42, guidance channel 48, guidance channel 50, and terminating channel 52 by pulling on the anterior end 54 (FIG. 5) of the retaining cable 40, effectively releasing the retaining cable 40 from the retaining loops 42, guidance channel 48, guidance channel 50, and terminating channel 52. As FIG. 6 illustrates, the retaining loops 42 are now capable of passing through the apertures 46 in the left posterior portion 8 of the protective shoulder pads 2 with the retaining cable 40 evacuated from the retaining loops 42. With the individual wearing the protective shoulder pads 2 still maintained in the supine position, the coupling that attaches the two anterior portions of the shoulder pads can be separated, thus providing two separate left and right halves of the protective shoulder pads 2. The separate shoulder pads 2 can subsequently be removed laterally from underneath the individual wearing the protective shoulder pads 2 without moving the individual wearing the protective shoulder pads 2 to any detrimental degree. A full diagnosis of the individual wearing the protective shoulder pads 2 is now possible. The left protective shoulder pad 8 and the right protective shoulder pad 9 may be recoupled to form complete protective shoulder pads 2 for future use.

It is to be understood that while certain forms of this invention have been illustrated and described, it is not limited thereto except insofar as such limitations are included in the following claims and allowable equivalents thereof.

The invention claimed is:

1. Shoulder pads for use in a contact sport, comprising:

a left shoulder pad portion and a right shoulder pad portion, each with anterior, superior and posterior portions;

wherein the anterior portions depend from an anterior face of the superior portions and the posterior portions depend from a posterior face of the superior portions;

wherein the right and left shoulder pad portions are in communication at the anterior, superior, and posterior portions; and a release mechanism enabling removal of the shoulder pads while the wearer is in the supine position;

wherein a portion of the release mechanism is disposed on the posterior portion of the pads; and wherein the release mechanism is operable to separate a first removable portion of the pad from a second removable portion of the pad while the wearer remains in the supine position wherein the release mechanism includes:

a strap with a first end terminating in a loop and a second end in communication with the first removable portion of the pads;

an aperture disposed on the second removable portion of the pads;

wherein the loop is received by the aperture; and a removable retention cable threaded through the loop received in the aperture and retaining the first end of the strap in the aperture thereby assembling the first and second removable portions of the pad;

wherein the retention cable extends substantially along the posterior portion of the pads and having a first end terminating at the anterior portion of the pads;

wherein removal of the retention cable from the loop permits the first end of the strap to egress back through the aperture allowing disassembly of the first removable portion from the second removable portion.

2. The shoulder pads of claim 1, wherein the first removable portion is the left shoulder pad portion and the second removable portion is the right shoulder pad portion.

3. The shoulder pads of claim 1, wherein the first removable portion is the right shoulder pad portion and the second removable portion is the left shoulder pad portion.

* * * * *